United States Patent [19]

Tascarella

[11] 4,441,222

[45] Apr. 10, 1984

[54] AUTOMATIC BED MAKER

[76] Inventor: Peter J. Tascarella, 2526 Brookdale Ave., Roslyn, Pa. 19001

[21] Appl. No.: 288,614

[22] Filed: Jul. 30, 1981

[51] Int. Cl.[3] ..... A47C 21/00; A47C 21/02

[52] U.S. Cl. ..... 5/488

[58] Field of Search ..... 5/488, 482, 508; 38/143

[56] References Cited

U.S. PATENT DOCUMENTS

| | | | |
|---|---|---|---|
| 3,228,127 | 1/1966 | Roiland | 38/143 |
| 3,271,889 | 9/1966 | Long | 38/143 |
| 3,287,838 | 4/1966 | Mazzolla | 38/143 |
| 3,343,183 | 9/1967 | Sannes | 5/488 |
| 3,581,321 | 6/1971 | Geary | 5/488 |
| 3,855,655 | 12/1974 | Probst | 5/488 |
| 4,024,591 | 5/1977 | Raczkowski | 5/488 |
| 4,042,985 | 8/1977 | Raczkowski | 5/488 |
| 4,305,167 | 12/1981 | Bargados | 5/488 |

FOREIGN PATENT DOCUMENTS

| | | | |
|---|---|---|---|
| 649439 | 10/1962 | Canada | 5/488 |

*Primary Examiner*—Alexander Grosz

*Attorney, Agent, or Firm*—John J. Simkanich

[57] ABSTRACT

An electrically-operated bed cover making apparatus secured to the frame of a bed and operable to cause a framework carrying a plurality of arms to be lifted from the foot of the bed to the head by utilizing a pair of rotating wheels on either side of the bed frame, including on each of the plurality of arms, a roller having a helical screw like rib for engaging and smoothing wrinkles out of the bed covers from center to sides, a tie down structure for securing the covers to the foot of the bed, this tie down structure being pivotable via a lever system, such pivoting allowing for an interleaving of the plurality of arms carried on the framework with the securing structure upon the return to the foot of the bed of these arms, and a limit switch type control for automatically directing the electrical operation and limits of movement of the apparatus.

15 Claims, 5 Drawing Figures

AUTOMATIC BED MAKER

BACKGROUND OF THE INVENTION

This invention relates to apparatus for the automatic handling or straightening of the bed covers and sheets, and in particular relates to an apparatus which may be applied to a bed for making and then remaking the sheets and other bed covers.

Flatwork and sheet handling equipment have in the past included helical type spreaders as part of power driven conveyor systems for drawing flatwork straight or taut from the middle of the sheet. Such apparatus have been taught by Roiland, U.S. Pat. No. 3,228,127, Long, U.S. Pat. No. 3,271,889, and Mazzolla, U.S. Pat. No. 3,287,838. In each instance the flatwork spreader is a roller having a helical screw type rib curving outwardly from the middle of the sheet to each side thereof. The coiled winding of each screw formation goes in opposite directions to act in conjunction with one another to smooth wrinkles out of the flatwork from the center to the outer edges. In each instance these rollers are power driven by belt, chain or other means from electrical motors and are incorporated as a part of a conveyor or transfer system.

Geary, U.S. Pat. No. 3,581,321, Propst, U.S. Pat. No. 3,855,655, and Raczkowski, U.S. Pat. No. 4,024,591, each teach bed making apparatus having one or more arms each holding one of a plurality of covers or sheets. Essentially, these bed making apparatus hang the cover or sheet lengthwise from one end and then lay the cover or sheet onto the bed, with the bottom portion of the previously hanging cover or sheet becoming the free or headboard end of that cover.

While the bed making apparatus of Geary, Propst and Raczkowski can be repeatedly used for making the same bed, such apparatus do not assure that the sheets and bedclothes are straightened and pulled flat from the center of the bed.

The heavy driven roller systems of Roiland, Long and Mazzolla, while applicable to conveyor and other transfer systems are not adaptable to the bed making apparatus as taught by Geary, Propst and Raczkowski.

What is needed is a bed making apparatus which is capable of making and remaking the bed covers while smoothing the bed covers in place and returning to its initial position. Moreover, besides remaking the bed covers with respect to their longitudinal position, such an apparatus should be able to smooth the wrinkles out of the bed covers from the center to the sides.

An object of this invention is to provide a bed making apparatus which is permanently attached to the frame of the bed and which folds down out of the way when not performing the bedmaking function.

A second object of this invention is to provide such a bed making apparatus which draws the covers up from the foot of the bed to the head of the bed tautly, while smoothing the covers from the center of the bed to the sides, and then returning to the initial position immediately upon completion of drawing the covers over the bed.

A further object is to provide such a bed making apparatus for making a bed having a plurality of sheets and covers, said bed making apparatus including at least one working arm for each sheet and at least one holding arm for each sheet, said working arms and said holding arms being interleaved during the rest position when the bed making apparatus is not in operation.

Another object of this invention is to provide an eletrical position monitor for the mechanical structure of the bed making apparatus whereby the structure is controlled to return to its initial position at the foot of the bed once it has completed the operation cycle to the head of the bed to be made.

SUMMARY OF THE INVENTION

The objects of this invention are realized in an automatic bed maker which draws a plurality of individual cover and sheet making arms up through each of its respectively associated covers or sheets thereby drawing that cover or sheet to the head of the bed while smoothing that cover or sheet from the middle of the bed.

A motor driven multi-arm framework is pivoted about the mid-length of a bed to be raised from the foot to the headboard of the bed via a pair of rotational wheels that are gear, chain and shaft driven from an electrical motor positioned under the bed. Each arm carries an idler roller having a helical screw configuration thereon. These idler rollers are paired on juxtaposed arms with their helical screw rib directions opposite for straightening a given sheet or cover from the center to the sides. As the framework is raised over the covers, these idler screw rollers on the arms frictionally engage the covers and operate to smooth them toward the edges of the bed, while the arms carry the covers to the head of the bed. Upon reaching the headboard of the bed, each arm extends beyond the free end of the covers and returns to the foot of the bed empty.

The bed making apparatus is started by a switch or button connected to the electrical control apparatus therefor. A limit switch detects when the multi-arm structure has reached the head of the bed and causes a reversal in the direction of the rotation of the wheels supporting the multi-arm structure and thereby the direction of movement of these arms.

Each cover and sheet for the bed is held securedly to the bottom of the bed by an individual holding rod. These holding rods are mounted and supported by a frame which is positioned on an axle for pivoting. This axle is caused to rotate upon the return stroke of the bed making multi-arm structure whereof an activator on one of the rotational wheels at mid-bed enables the movement of a lever arm system connected to that wheel for pivoting the axle thereby the holding rod supporting frame upwardly for receiving the returning multi-arm structure in an interleaved manner whereby the entire mechanical apparatus is folded downwardly into the foot of the bed to the inactive or rest position.

DESCRIPTION OF THE DRAWINGS

The advantages, features and operation of this invention are better understood from a reading of the following detailed description of the invention in conjunction with the attached drawings in which like numerals refer to like elements and in which.

DETAILED DESCRIPTION OF THE INVENTION

Figure 1:
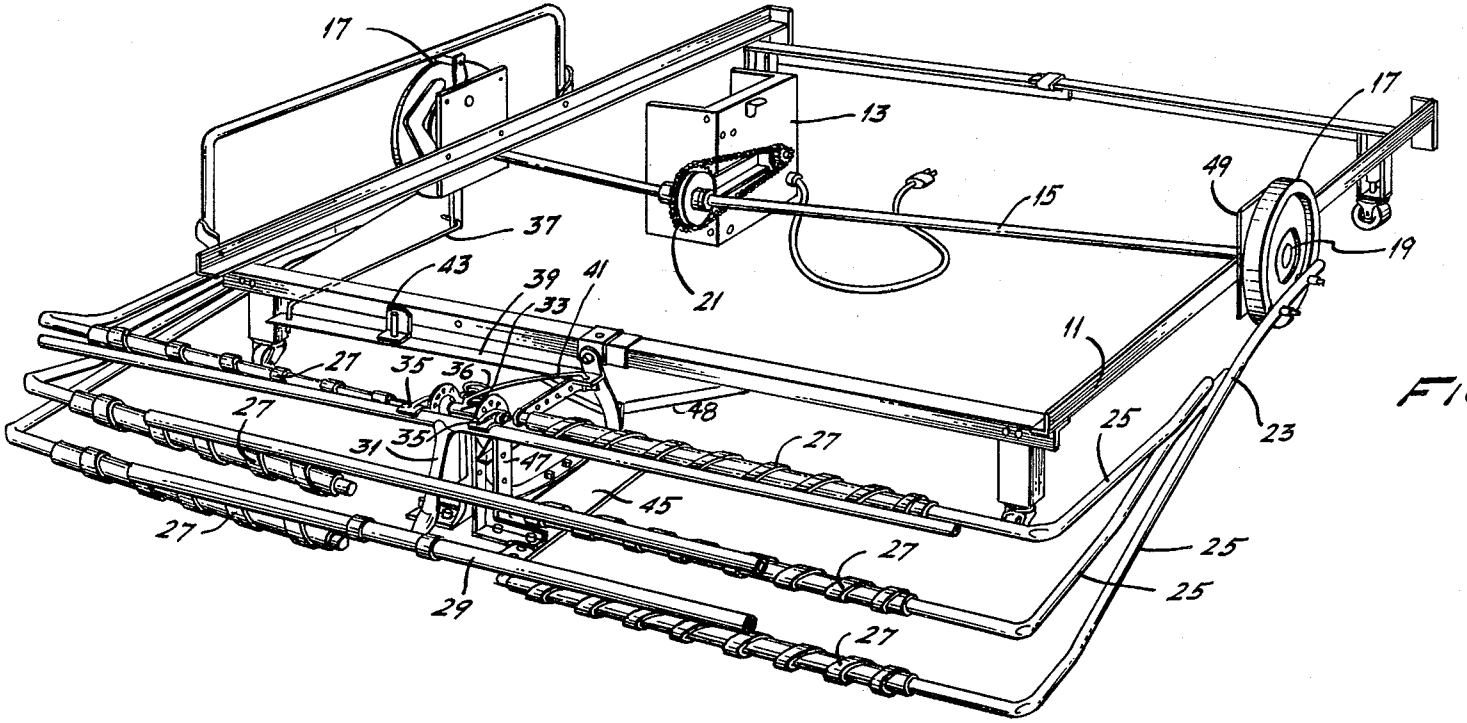
FIG. 1 shows a perspective view of the bed making apparatus installed on a frame in the rest position.

The automatic bed making apparatus of the present invention is connected at mid-length to and operates in relation with a bed frame, such as the metal bed frame 11 shown in FIG. 1. Such bed frame 11 is of a type often used in hospitals and nursing homes. An electrical motor box 13 containing an electrical motor and electrical control switching is positioned below the level of the frame 11, at approximately the center of the bed, midway between the headboard and the foot of the bed. The electrical motor contained within the motor box 13 is of the reversing type. The drive output from the motor box 13 is connected to a shaft 15 for driving a pair of wheels 17, these wheels being positioned on idler shafts 19 on either side of the bed frame 11 at approximately the midpoint between the head and foot thereof. The drive shaft 15 is connected to the motor box 13 by a sprocket and chain drive 21. Any of a plurality of other power trains such as gear and shaft or belt and pulley may be substituted for the sprocket and chain 21. By driving each of the operational wheels 17 off the same shaft 15 their function and performance is synchronized and duplicated on each side of the bed frame 11.

Each wheel 17 has a L-shaped framework 23 connected thereto, each framework 23 having a plurality of arms 25 extending therefrom. Each arm 25 extends from the side of the bed inwardly to a distance just short of the middle of the bed frame 11 to be juxtaposed with a paired arm 25. Mounted on each arm 25 is an idler helical screw roller 27 which is free to turn and oriented to draw to the side of the bed frame 11 as it turns.

As the wheels 17 are rotated, the respective framework 23 and the arms 25 with the helical screw rollers 27 are drawn from the foot of the bed frame 11 in a semicircular curve or arc to the head of the bed frame 11. Each arm 25 and its carried helical screw 27 passes under a respective one of the covers or sheets on the bed 11. The helical screw rollers 27 frictionally engage its respective cover to draw the cover toward the head of the bed frame 11 while also turning through frictional contact to straighten the cover. This rotation of the helical screw roller 27 acts to smooth the wrinkles toward the edge of the bed.

Figure 3:
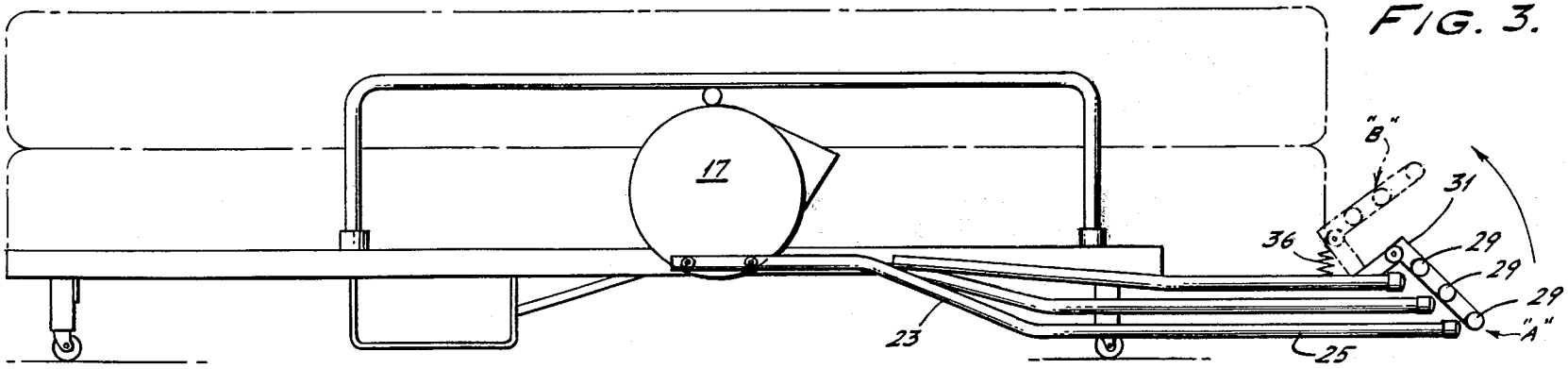
FIG. 3 shows a side elevation of the bed making apparatus.
Figure 2:
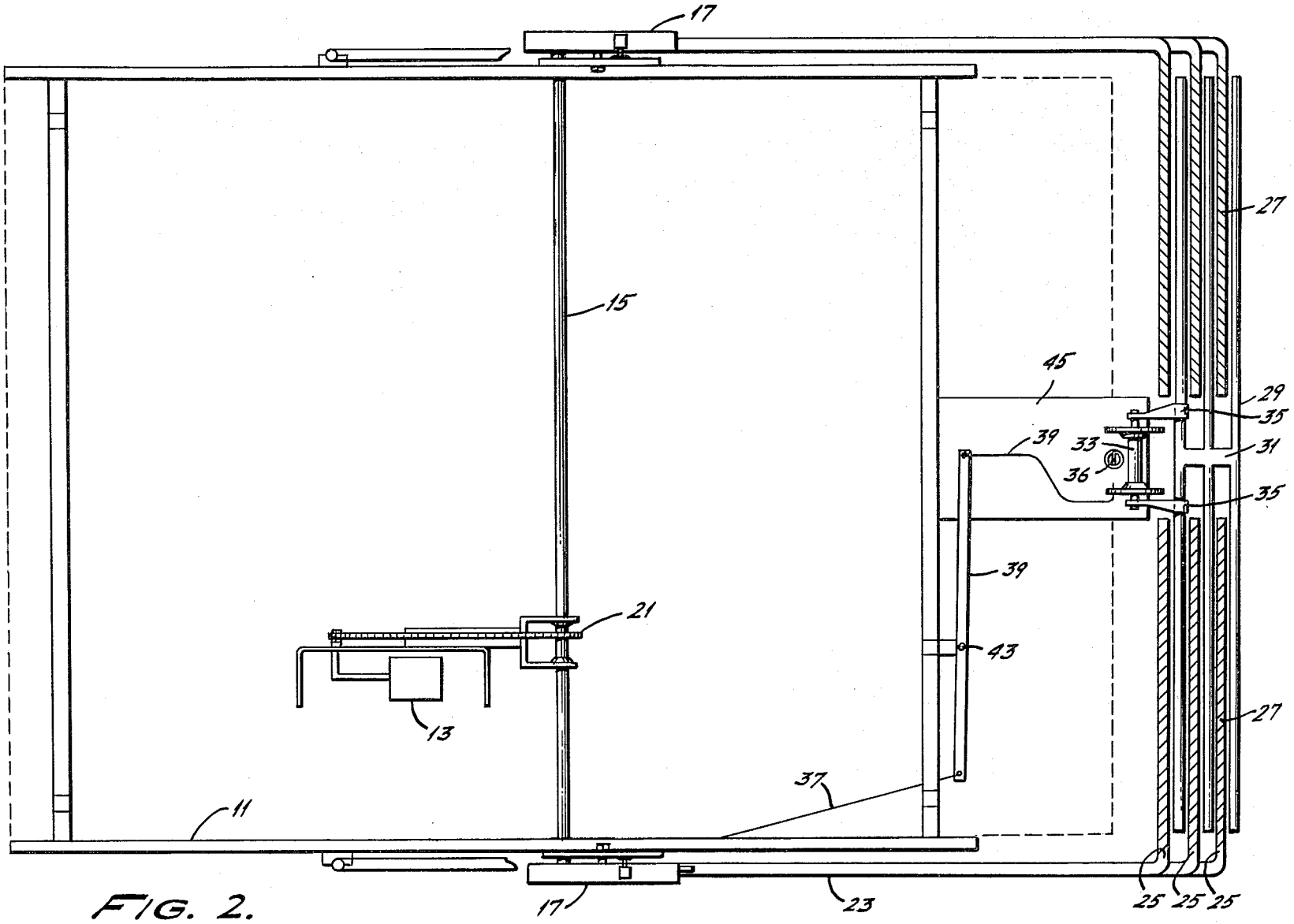
FIG. 2 shows a plan view of the bed making apparatus of FIG. 1.

In the configuration for the framework 23 and arms 25 shown in FIGS. 1, 2 and 3, the bed making apparatus is configured for making and straightening three layers of covers. There are three pairs of arms 25. The framework 23 and arms 25 are configured so that the top one of the respective arms 25 and its roller 27 is positioned closest to the bottom of the bed while the bottom of the respective ones of the arms 25 and its respective roller 27 is positioned furthest from the bottom of the bed as seen in FIGS. 2 and 3.

Covers and sheets carried on the bed are held securely to the foot of the bed by a tree-like frame having an individual securing bar 29 for each cover. A main support bar 31 holds each of the individual securing bars 29. These securing bars 29 are positioned with the top one closest to the bed frame 11 and the bottom furthest from the foot of the bed frame 11 in a corresponding positioned relationship to the individual ones of the arms 23 holding helical screw rollers 27, FIG. 3.

Each securing bar 29 may have its respective cover held thereto by a clamp, a slit overiding tube or other means.

The spacing between the individuals ones of the securing bars 29, the angle of repose of the main support bar 31 in the rest position of the foot of the bed frame 11, the length of the framework 23 and arms 25, and the arc swing of the individual arms 25 and their associated helical screw rollers 27 is adjusted so that the individual screw rollers 27 swing through and in between the securing bars 29 when the wheels 17 and framework 23 carrying the arms 25 are swung during the bed making operation.

The main support bar 31 is held in a position which is offset from the center of a rotational axis implemented by the axle 33. A pair of rotational support bars 35 are bolted for rotation on the axis 33 and bolted, welded or clamped to the top securing bar 29 adjacent to and on either side of the main support bar 31. When the axle 33 is caused to rotate, the rotational support bars 35 swing the main support bar 31 and the securing bars 29 in a circular arc from "Position A" of FIG. 3 to "Position B" under the influence of spring 36. This is accomplished as the wheels 17 and framework 23 cause the arms 25 and their respective helical rollers 27 to return from the head of the bed. This allows the rollers 27 to interleaf between the individual securing bars 29 and the covers held thereby for the next bed making operation. As the framework 23, arms 25 and rollers 27 are returned to the rest position, the main support bar 31 and securing bars 29 are also returned to their original position "A'."

The axle 33 is caused to rotate by the operation of one of the wheels 17 in combination with a lever arm system comprising a first rod 37, lever 39 and a second rod 41. This second rod 41 is tied to the axle 33 which it rotates as the second rod 41 moves forward or backward. The lever 39 pivots about a pin 43 secured to the bed frame 11.

The axle 33 is held in position by a support structure including a base plate 45 and braces 47, 48 secured to that base plate 45 and the center of the bottom of the bed frame 11.

The sequence of operation of the rotation of the axle 33, main support bar 31 and securing bars 29 for receiving and interleaving the arms 25 and helical screw rollers 27 on their return stroke is mechanically operated from the one of the rotational wheels 17.

Figure 4A:
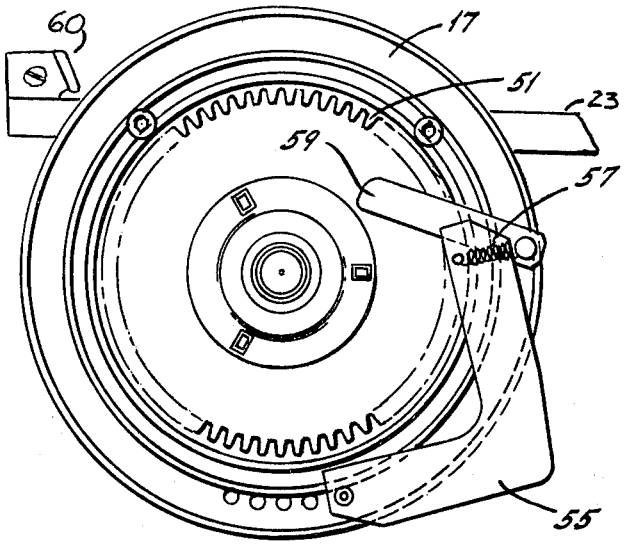
FIG. 4*a* shows the rotational sheet at mid-bed with lever arm system activator.
Figure 4B:
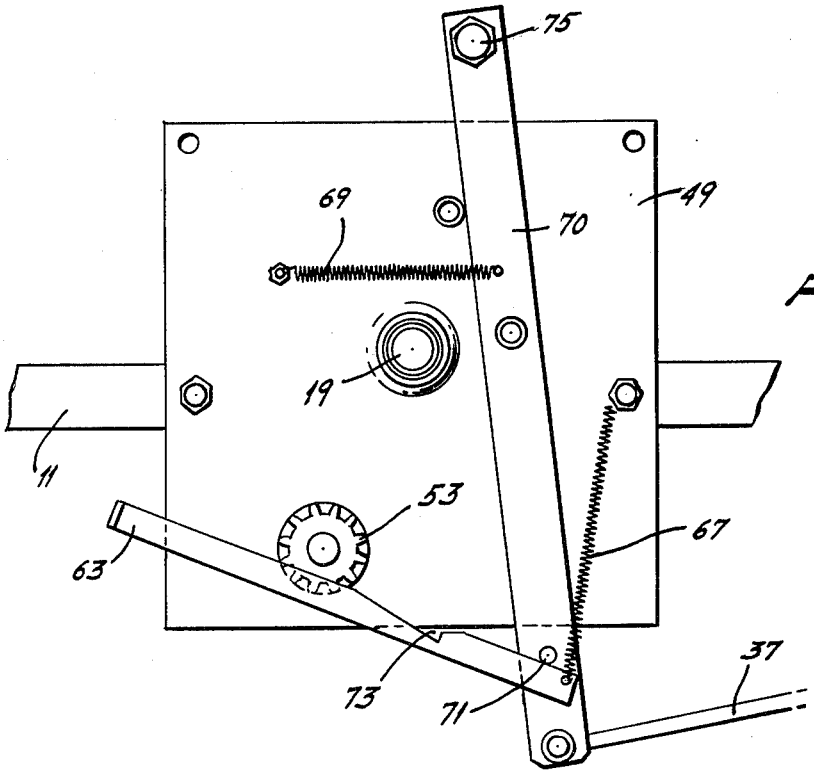
FIG. 4*b* shows the mating mounting bracket for the wheel of FIG. 4*a* with the carried shafts and coacting lever arm system shown in part.

Each of these wheels 17, FIG. 4*a*, is mounted for rotation upon an idler shaft 19, FIG. 4*b*, which is secured to a mounting plate 49 mounted to the bed frame 11. This mounting plate 49 can be rectangular or square or of other convenient shape. A ring gear 51, forms a part of the interior section of each wheel 17. This ring gear 51 is connected to a small pinion gear which drives the ring gear 51. The pinion gear 53 is mounted on each end of the shaft 15. The shaft 15 on each end extends through the respective one of the mounting plates 49 and is supported for rotation by a sleeve bearing or other means (not shown).

A first cam 55, being a dog leg shaped plate, is mounted near the ring gear 51 of that one of the wheels 17 and is biased to an initial position by a first spring 57. A bar 59 is fixedly positioned on the inside of the wheel 17 adjacent to the first cam 55. This bar 59 is a rectangular plate that extends across a section of the ring gear 51 teeth and is intended to act as a guide keeping the first cam 55 from catching onto or dropping into the ring gear 51. As the wheel 17 is not caused to rotate a full 360 degrees, the bar 59 does not interfere with the operation of the spur gear 53 and ring gear 51.

When the wheel 17, FIG. 4*a*, is caused to rotate to begin the return path of the bed making apparatus, the first cam 55 rides against a third lever 70, FIG. 4*b*, having a cam following pin 75 thereon. This third lever 70 reacts against the rod 37 to operate that first rod 37. This third lever 70 is biased to an initial position by means of a second spring 69. A fourth lever 63 acts as a locking rod and acts as a cam follower which has one edge which rides against a second pin 71 on the third lever 70. This fourth lever is biased by the spring 67. This lever 63 has a notch 73 cut in that side for catching and holding the second cam follower pin 71.

The second cam 60 positioned at the end of the framework 23 catches against the lip of the third lever 63 at the end of the return stroke to release this lever 63 from holding the third lever 70. This allows the third lever 70 to return to its initial position by means of the spring 67, and carrying to its initial position also the first lever 37 and main support bar 31, securing bars 29 et al. with the aid of the previously compressed spring 36, FIG. 2, which acts against the support bar 31.

The first cam 55 contacts and moves the lever 65 by riding against the first pin 75. The dog leg shaped first cam 55 is pinned for rotation on one end and biased to an initial position by the first spring 57 on the other end. When the leg of this cam 55 adjacent the spring 57 rides against the first pin 75 on the end of the third lever 65 it moves that pin 75 and the lever 70 to ride up the fourth lever 63 until the cam follower pin 71 engages the notch 73 of that fourth lever 63. At the end of the return stroke, the pin side of the first cam 55 rides against the second pin 75 and is moved aside because of the action of the spring 57. It is the engagement of the second cam 60 with the lip of the fourth lever 63 which releases the cam follower pin 71 from the notch 73 and allows the fourth lever 65 to return to its initial position thereby resetting the securing bar 29 structure against the foot of the bed.

Many changes can be made in the above described automatic bed maker apparatus without departing from the intent and scope thereof. It is intended therefore that the above description and accompanying drawings be considered as illustrative and not read in the limiting sense.

What is claimed is:

1. An automatic bed maker apparatus, comprising:

a bed frame;

at least one bed covering;

means for securing each said bed covering individually at the foot of said bed frame, said securing means being connected to said bed frame; and means for extending each said individual bed covering up from the bottom of the bed frame while simultaneously making it smooth from the center toward the sides of said bed frame by helical screw action, said extending and making smooth means being connected to said securing means.

2. The apparatus of claim 1 wherein said extending and making smooth means performs said extending and making smooth operations simultaneously.

3. The apparatus of claim 2 including a plurality of individual bed coverings wherein said extending and making smooth means operates on each said individual bed covering simultaneously.

4. The apparatus of claim 3 wherein said extending and making smooth means operates upon said bed coverings from the foot of the bed frame towards the head of the bed frame during a bed making stroke.

5. The apparatus of claim 4 wherein said extending and making smooth means releases said bed coverings at the end of said bed making stroke, said extending and making smooth means performing a return stroke to said bed frame foot free of said bed coverings.

6. The apparatus of claim 5 wherein said securing means lifts the ends of said bed coverings at said foot of said bed frame for receiving said extending and making smooth means between individual bed covering at the end of said return stroke.

7. The apparatus of claim 6 wherein said securing means includes a plurality of securing bars extending horizontally at the foot of said bed frame, each bar holding an individual one of said coverings, said securing bars being connected to said bed frame.

8. The apparatus of claim 7 wherein said securing means includes:

an axle connected to said bed frame and supported above the floor at the foot of said bed frame;

a main support bar holding each of said plurality of securing bars spaced apart from one another; and a pair of rotational support bars connected to rotate with said axle and holding said main support bar and said plurality of securing bars.

9. The apparatus of claim 8 wherein said extending and making smooth means includes:

an electric motor;

a drive shaft supported across said bed frame being connected to be rotated by said electric motor;

a pair of wheels mounted one on each side of said bed frame, and being rotated in unison, one off of each end of said shaft;

a framework attached to each wheel and being rotated by the rotation of said wheel;

a plurality of arms attached to each said framework, said plurality corresponding to said plural number of said securing bars; and a helical screw roller mounted on each arm and extending horizontally to said bed frame.

10. The apparatus of claim 9 wherein said extending and making straight means has a rest position with said electric motor, said drive shaft and said pair of wheels stopped; said each framework extending from its respective wheel toward the foot of said bed frame in said rest position, said each arm extending from said framework around said foot of said bed frame to about the center thereof; and each roller is mounted on a respective one of said arms and extending parallel to said bed frame.

11. The apparatus of claim 10 wherein each said arm is spaced from one another about the same distance as said securing bars, said arms being interleaved between said securing bars in said rest position.

12. The apparatus of claim 11 wherein said securing means also includes a first lever and cam system operative off of one of said wheels and connected to rotate said axle.

13. The apparatus of claim 12 wherein said first lever and cam system operates to rotate said axle near the end of said drawing and straightening means return stroke, and to return said axle to its original position at the end of said return stroke.

14. The apparatus of claim 13 wherein said first lever and cam system includes:

a first mounting plate on one side of said bed frame to which a first one of said wheels is mounted;

a first and second levers mounted on said first mounting plate;

a first rod operated by said second lever;

a third lever pinned for rotation at the foot of said bed frame and connected to said first rod for rotation; and a second rod operated by said lever and connected to said axle to cause the rotation thereof.

15. The apparatus of claim 14 also including:

a second mounting plate attached to said other side of said bed frame for mounting said other wheel;

said drive shaft extending through each of said first and second mounting plates for rotation;

a pinion gear mounted on each end of said drive shaft;

an idler shaft mounted on each said mounting plate;

each said wheel being mounted for rotation on its respective said idler shaft;

a ring gear attached to the inner side of each wheel and engaging said respective pinion gear; and a second lever and cam system mounted on said inner side of said first wheel, said second lever and cam system engaging said first and second levers mounted on said first mounting plate.

* * * * *